US006688708B1

(12) United States Patent
Janson

(10) Patent No.: US 6,688,708 B1
(45) Date of Patent: Feb. 10, 2004

(54) STABILIZING AND ENCLOSURE SYSTEM FOR MOBILE STORAGE UNITS

(75) Inventor: Steven L. Janson, Deerfield, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 09/515,569

(22) Filed: Feb. 29, 2000

(51) Int. Cl.[7] ..... A47B 53/00
(52) U.S. Cl. ..... 312/200; 312/265.5; 312/334.28
(58) Field of Search ..... 312/198, 199, 312/201, 350, 330.1, 249.9, 263, 265.5, 334.25, 334.28, 334.33; 211/162

(56) References Cited

U.S. PATENT DOCUMENTS

| | | | | |
|---|---|---|---|---|
| 463,932 A | | 11/1891 | Allison | |
| 1,259,345 A | * | 3/1918 | Beecham | 312/334.28 |
| 2,848,293 A | | 8/1958 | Jurgens et al. | |
| 3,544,186 A | * | 12/1970 | Bjorge | 313/341 |
| 3,967,868 A | | 7/1976 | Baker, Jr. | |
| 4,039,040 A | | 8/1977 | Spears et al. | |
| 4,084,125 A | | 4/1978 | King | |
| 4,123,126 A | | 10/1978 | Querengasser | |
| 4,139,248 A | | 2/1979 | Hornbacher | |
| 4,657,317 A | | 4/1987 | Gemma | |
| 4,768,845 A | * | 9/1988 | Yeh | 312/263 X |
| 5,205,627 A | | 4/1993 | Davison et al. | |
| 5,265,739 A | | 11/1993 | Price, Jr. et al. | |
| 5,443,312 A | | 8/1995 | Schluter | |
| RE35,047 E | | 10/1995 | Potter | |
| 5,454,634 A | * | 10/1995 | Herbst et al. | 312/111 X |
| 5,466,058 A | * | 11/1995 | Chan | 312/263 X |
| 5,683,155 A | | 11/1997 | Sarno | |
| 5,813,735 A | * | 9/1998 | Wu | 312/199 X |
| 5,893,617 A | * | 4/1999 | Lee | 312/263 |
| 5,924,779 A | | 7/1999 | Krumholz | |
| 5,967,346 A | | 10/1999 | Price, Jr. | |
| 5,992,956 A | * | 11/1999 | Slivon | 312/334.25 |
| 6,027,190 A | | 2/2000 | Stewart et al. | |
| 6,036,286 A | | 3/2000 | Krumholz | |
| 6,312,068 B1 | * | 11/2001 | Benner et al. | 312/265.5 X |

FOREIGN PATENT DOCUMENTS

| | | |
|---|---|---|
| EP | 0045812 | 9/1981 |
| EP | 582775 | 2/1994 |
| EP | 1059050 A2 | 12/2000 |
| EP | 1059050 A3 | 12/2000 |
| GB | 1202484 | 8/1970 |
| GB | 1430326 | 3/1976 |
| GB | 2051560 | 1/1981 |
| GB | 2183147 | 6/1987 |
| GB | 2347616 | 9/2000 |
| WO | WO 85/00733 | 2/1985 |

OTHER PUBLICATIONS

Ultrastor High Density Storage Brochure, Stewart Systems, P.O. Box 680625, Franklin, TN 37068, undated.

* cited by examiner

*Primary Examiner*—Lanna Mai
*Assistant Examiner*—Hanh V. Tran
(74) *Attorney, Agent, or Firm*—Boyle, Fredrickson, Newholm, Stein & Gratz, S.C.

(57) ABSTRACT

A stabilizing and enclosure system for a series of side-by-side mobile storage units. Each mobile storage unit includes a storage member, such as a cabinet assembly, mounted for extendible and retractable movement relative to a base which is rigidly fixed to a supporting structure such as a floor. A stationary stabilizing member is provided for each storage unit. An extendible and retractable engagement mechanism is interposed between each stabilizing member and the storage member of each storage unit, and is movable along with the storage member upon movement between its extended and retracted positions for maintaining engagement of the storage unit with the stabilizing member, to prevent the storage unit from tipping. In one embodiment, each stabilizing member is in the form of a top panel which overlies one of the storage units. Adjacent top panels are connected together, and each top panel is preferably engaged with the storage unit base by a vertical post.

12 Claims, 8 Drawing Sheets

STABILIZING AND ENCLOSURE SYSTEM FOR MOBILE STORAGE UNITS

FIELD OF THE INVENTION

This invention relates to mobile high density storage systems, and more particularly to a system for stabilizing and enclosing a series of storage units in a high-density storage system.

BACKGROUND AND SUMMARY OF THE INVENTION

High density storage systems are commonly used to store objects which require easy access, such as books or files, and generally include a series of mobile storage units located immediately adjacent each other without spaces or aisles between the storage units. In one form, the storage units are mounted on carriages which are movably engaged with floor-mounted tracks, which enable the storage units to be moved so as to provide an aisle or space between adjacent storage units to provide access to the stored objects. The tracks extend perpendicularly to the longitudinal axes of the storage units, and a number of carriages are mounted to the tracks for lateral movement, to selectively create an aisle or space between adjacent storage units. In another form, the storage units may be mounted to a base having a cantilevered or wheeled pull-out system, for enabling a single storage unit to be pulled out relative to adjacent storage units along the longitudinal axis of the storage unit, to provide access to the contents of the storage unit without creating an aisle or space between adjacent storage units.

Various anti-tipping arrangements are known for use with track-type high density storage systems. Some examples are shown in Peterman U.S. Pat. No. 4,618,191; Peterman U.S. Pat. No. 4,708,411; Peterman U.S. Pat. No. 4,770,475; and Muth U.S. Pat. No. 5,013,101, all of which are owned by the same assignee as the present application. Other arrangements are shown in Hoska et al U.S. Pat. No. 5,597,217 and Davison et al U.S. Pat. No. 5,205,627. All of these patents disclose anti-tipping systems which are located at the bottom of the storage unit or carriage, which interact with structure mounted to the floor or to the track for preventing the storage unit from tipping. While anti-tipping systems of this type are well suited for use with storage units in a high density track-type application, such systems are not suitable for use with pull-out systems which do not utilize a track mounted to a floor. Further, known anti-tipping systems typically involve modification of the structure of the track or mounting of an anti-tipping member to a floor, which increases the cost and complexity of the track or the overall system. Further, anti-tipping systems of this type require installation at the time the track is installed, and are not well suited for retrofit installation.

It is an object of the present invention to provide a stabilizing or anti-tipping arrangement for use in a high density storage system, which does not rely upon the track or upon a floor-mounted structure for preventing storage units from tipping. It is a further object of the invention to provide such an anti-tipping arrangement which is especially well suited for a pull-out type high density storage system. A still further object of the invention is to provide such an anti-tipping arrangement which is simple in its components and installation, yet which provides a positive and reliable anti-tipping feature for a high density storage system. A still further object of the invention is to provide a combination stabilizing and enclosure system for a series of side-by-side storage units. Yet another object of the invention is to provide such an arrangement which can be retrofit for use with existing high density storage systems.

In accordance with the invention, a stabilizing or anti-tip device for a movable storage unit includes a stabilizing member located above the center of gravity of the storage unit and adapted for mounting to a fixed structure. A telescoping slide assembly is interconnected between the stabilizing member and the storage unit. The telescoping slide assembly is operable to maintain engagement of the storage unit with the stabilizing member as the storage unit is moved between its retracted position and its extended position, to prevent tipping of the storage unit.

The stabilizing member may be mounted to the fixed structure by means of a mounting member engageable with the fixed structure, and the stabilizing member may in turn be secured to the mounting member. The mounting member may be in the form of a bracket adapted for mounting to the fixed structure, such as a wall. In another form, the stabilizing member may be interconnected with the base of the storage unit, or the base of an adjacent storage unit. The storage unit bases, in turn, are mounted to the fixed structure, such as a floor. The telescoping slide assembly includes a stationary channel member adapted for mounting to the stabilizing member, and an extension member movably mounted to the stationary channel member and adapted for connection to the storage unit. In one embodiment, the extension member is secured to the top of the storage unit. The telescoping slide assembly may be in the form of a conventional slide assembly typically employed to mount a drawer to a cabinet. The invention employs such a slide assembly in a unique application for preventing a storage unit from tipping.

The invention further contemplates a system for enclosing a series of side-by-side mobile storage units. In accordance with this aspect of the invention, a top panel is adapted for placement over the top of each storage unit. Each top panel includes connection structure along its side edges, and the connection structure of adjacent top panels is adapted to be secured together. An end panel is adapted to be positioned over the outer side area of each of the endmost storage units. The upper edge of each end panel is engageable with the connection structure at the outer side edge of the endmost top panel, for securing the end panel to the interconnected top panels. The lower edge of each end panel is secured to the base of the endmost storage unit, which in turn is rigidly secured to the floor or other supporting surface. In a preferred embodiment, the telescoping slide assembly is engaged between each top panel and the top end of one of the storage units, which is spaced slightly below the top panel. In this manner, the interconnected top panels and end panels provide the stabilizing structure with which each telescoping slide assembly is engaged, so that the anti-tip device stabilizes the storage units against tipping without interconnection with the wall. A rear panel is provided for each storage unit, and the rear panels are interconnected together in a manner similar to the top panels. The outer edge of each end panel is adapted for connection to the endmost rear panel, and a reinforcing member is interconnected between the base of each storage unit and the rear panel, for imparting rigidity to the overall structure. This aspect of the invention thus provides a structure by which the storage units are enclosed, and also provides a stabilizing housing formed about the storage units for enclosing the tops and ends of the storage units. The telescoping slide assemblies are engaged for stabilizing the storage units as the storage units are moved between the extended position and the retracted position.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings

DETAILED DESCRIPTION OF THE INVENTION

Figure 1:
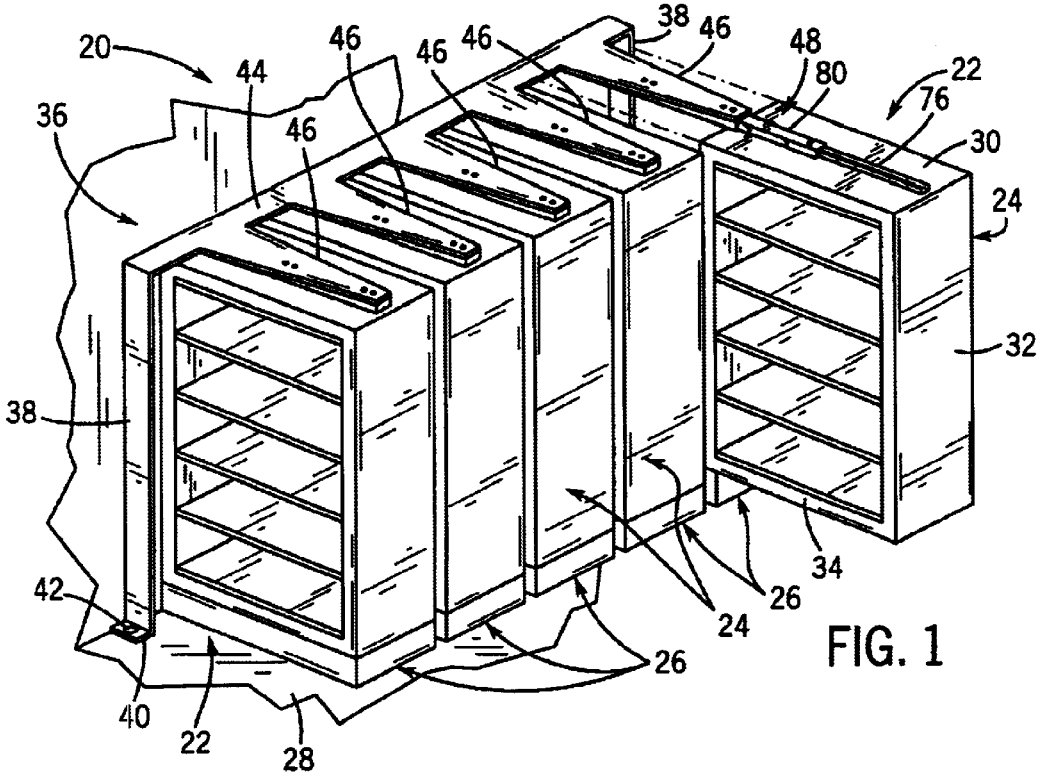
FIG. 1 is an isometric view of a series of storage units, each of which is interconnected with an anti-tip device in accordance with one embodiment of the present invention.
Figure 2:
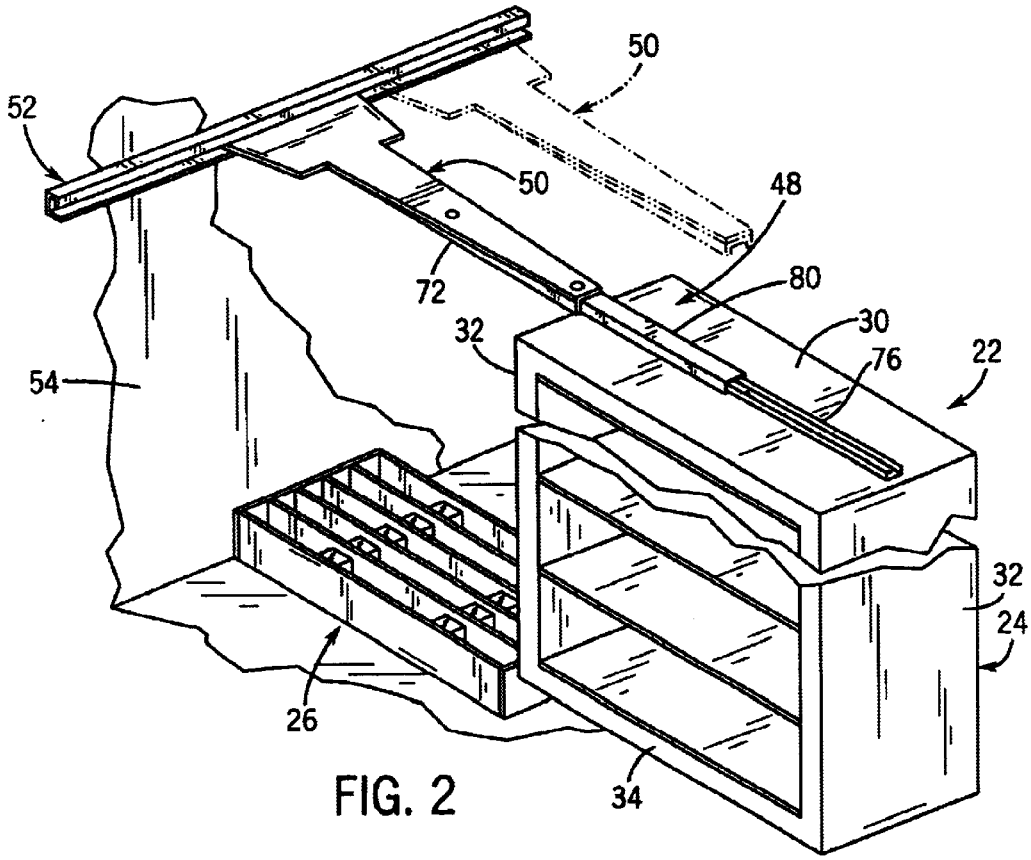
FIG. 2 is an isometric view of a single storage unit in an extended position, showing a second embodiment of the anti-tip device of the invention.

FIG. 1 illustrates a storage system 20 which includes a series of storage units 22, each of which generally includes a cabinet assembly 24 and a base assembly 26. Each cabinet assembly 24 is mounted to its respective base 26 for movement between a retracted position and an extended position. Each storage unit 22 may be constructed as disclosed in co-pending application Ser. No. 09/328,478 filed Jun. 9, 1999, the disclosure of which is hereby incorporated by reference. In this construction, each cabinet assembly 24 is mounted to a wheeled base 26, and the wheels of base 26 are movable on the floor, shown at 28, for moving the storage unit 22 between its extended position and its retracted position. Alternatively, storage units 22 may be constructed according to the disclosure of co-pending patent application Ser. No. 09/265,735 filed Mar. 10, 1999, the disclosure of which is hereby incorporated by reference. In this type of system, which is illustrated in FIGS. 1 and 2, each base 26 is rigidly mounted to floor 28, and cabinet assembly 24 is movable between a retracted position in which cabinet assembly 24 is located over base 26, and an extended position in which cabinet assembly 24 is moved outwardly relative to base assembly 26 in a cantilever-type fashion. A sliding support mechanism is interposed between base assembly 26 and cabinet assembly 24 for providing movement of cabinet assembly 24 relative to base assembly 26 and for supporting cabinet assembly 24 when in its extended position.

In accordance with conventional construction, cabinet assembly 24 includes a top wall 30, a pair of depending side walls 32, and a bottom 34 extending between the lower ends of side walls 32. The invention contemplates a stabilizing system 36 interconnected with storage units 22 for providing stability to storage units 22 both when in the extended position and in the retracted position, to prevent storage units 22 from tipping over.

Stabilizing system 36 includes a pair of end posts 38, each of which is rigidly mounted at its lower end to floor 28 via a foot 40 and an anchor bolt 42 which extends through foot 40 and into floor 28. Each post 38 is located adjacent the outer side of an endmost one of storage units 22. A top cross-member 44 extends between and is connected to the upper ends of posts 38.

A series of stabilizing members 46 extend outwardly from top cross-member 44. Stabilizing members 46 extend outwardly along parallel longitudinal axes which are oriented perpendicular to the longitudinal axis of cross-member 44. Each stabilizing member 46 is located above one of storage units 22, and is spaced above the storage unit top wall 30. The outer end of each stabilizing member 46 is located slightly inwardly of the outer side wall 32 of its respective storage unit 22 when the storage unit 22 is in its retracted position.

An extendible and retractable slide-type engagement mechanism 48 is interposed between each stabilizing member 46 and top wall 30 of the storage unit 22 over which the stabilizing member 46 is located. Engagement mechanism 48 may be in the form of a conventional slide mechanism typically employed to slidably mount a drawer to a cabinet or frame. Representatively, slide-type engagement mechanism 48 may be that such as is available from Jonathan Manufacturing Corp. of Fullerton, Series 370.

Figure 3:
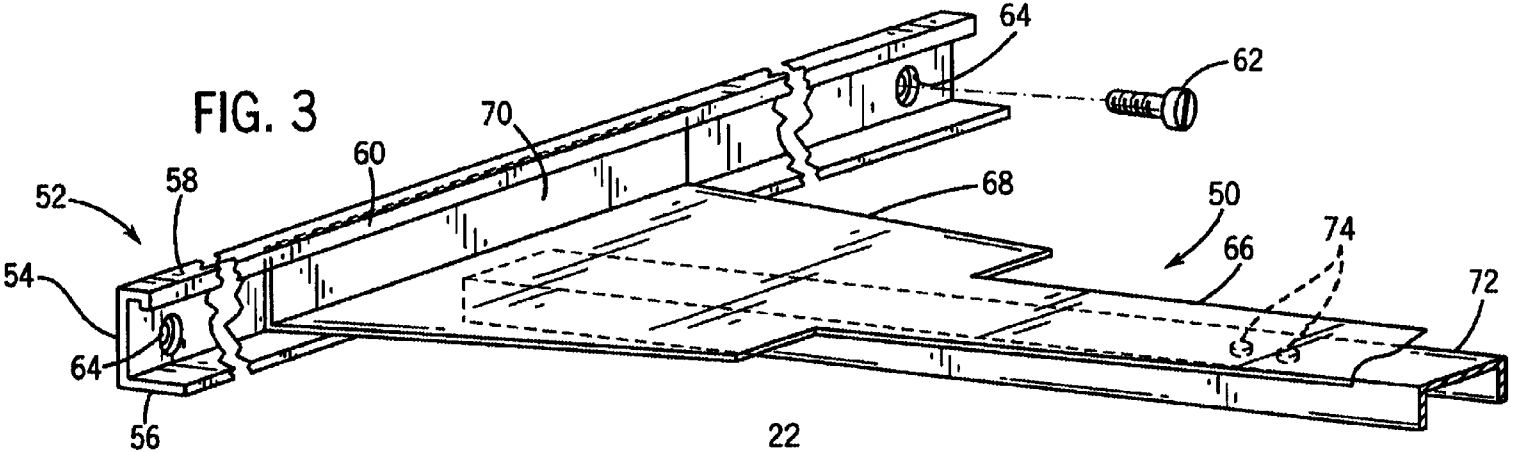
FIG. 3 is an enlarged partial isometric view of a portion of the anti-tip device of FIG. 2.
Figure 4:
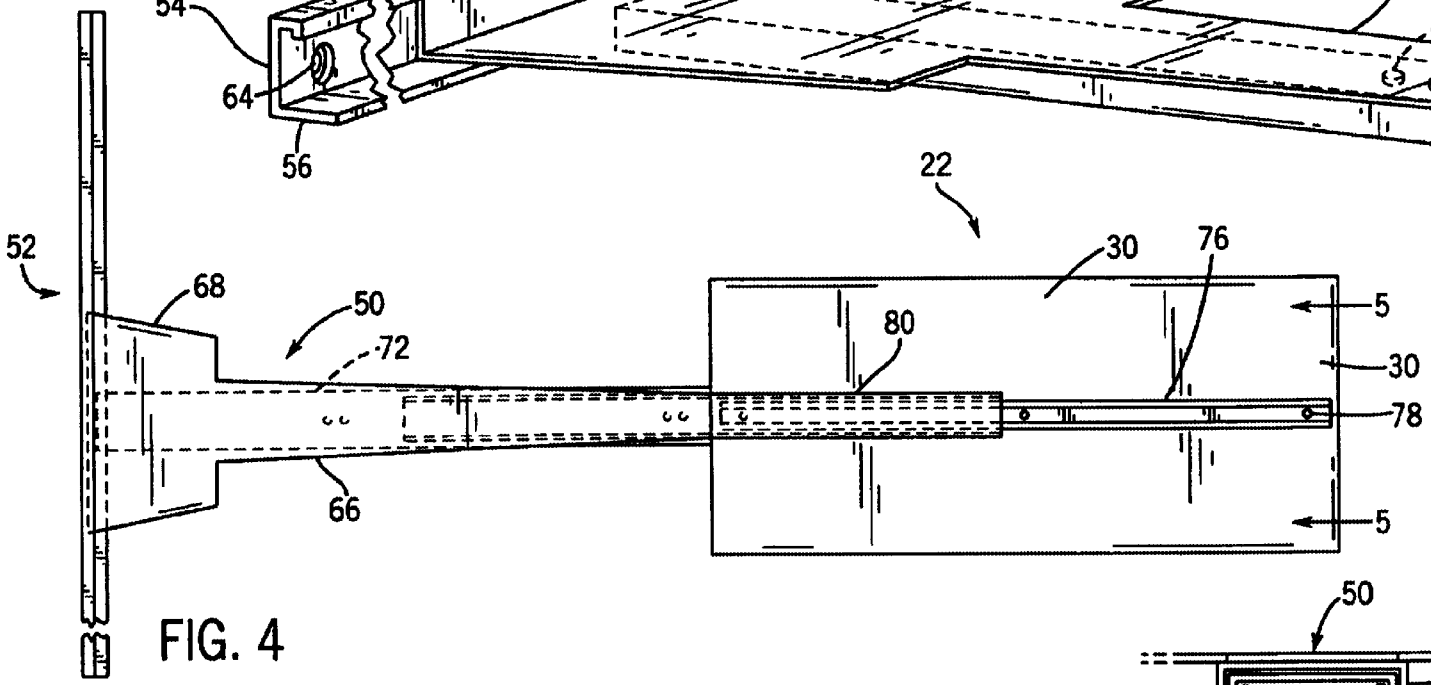
FIG. 4 is a top plan view of the extended storage unit and anti-tip device of FIG. 2.
Figure 5:
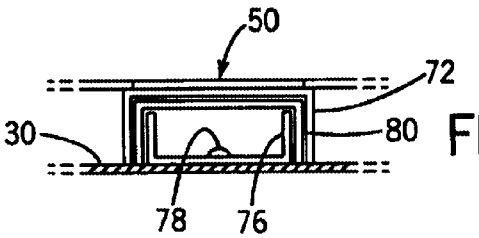
FIG. 5 is a partial section view taken along line 5—5 of FIG. 4.
Figure 6:
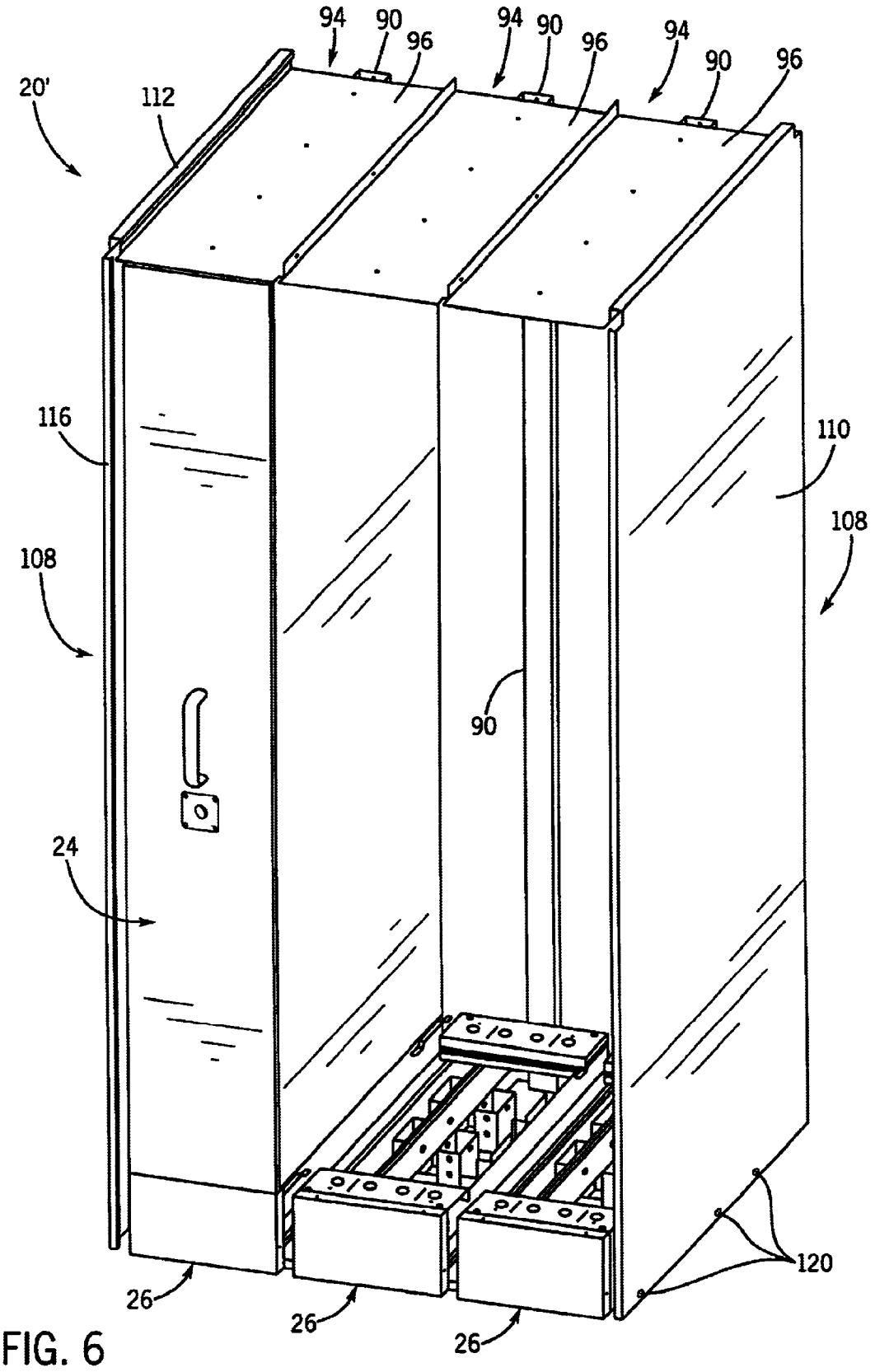
FIG. 6 is an isometric view of a stabilizing and enclosure system constructed according to the invention, for enclosing a series of storage units and for providing an anti-tip feature.
Figure 7:
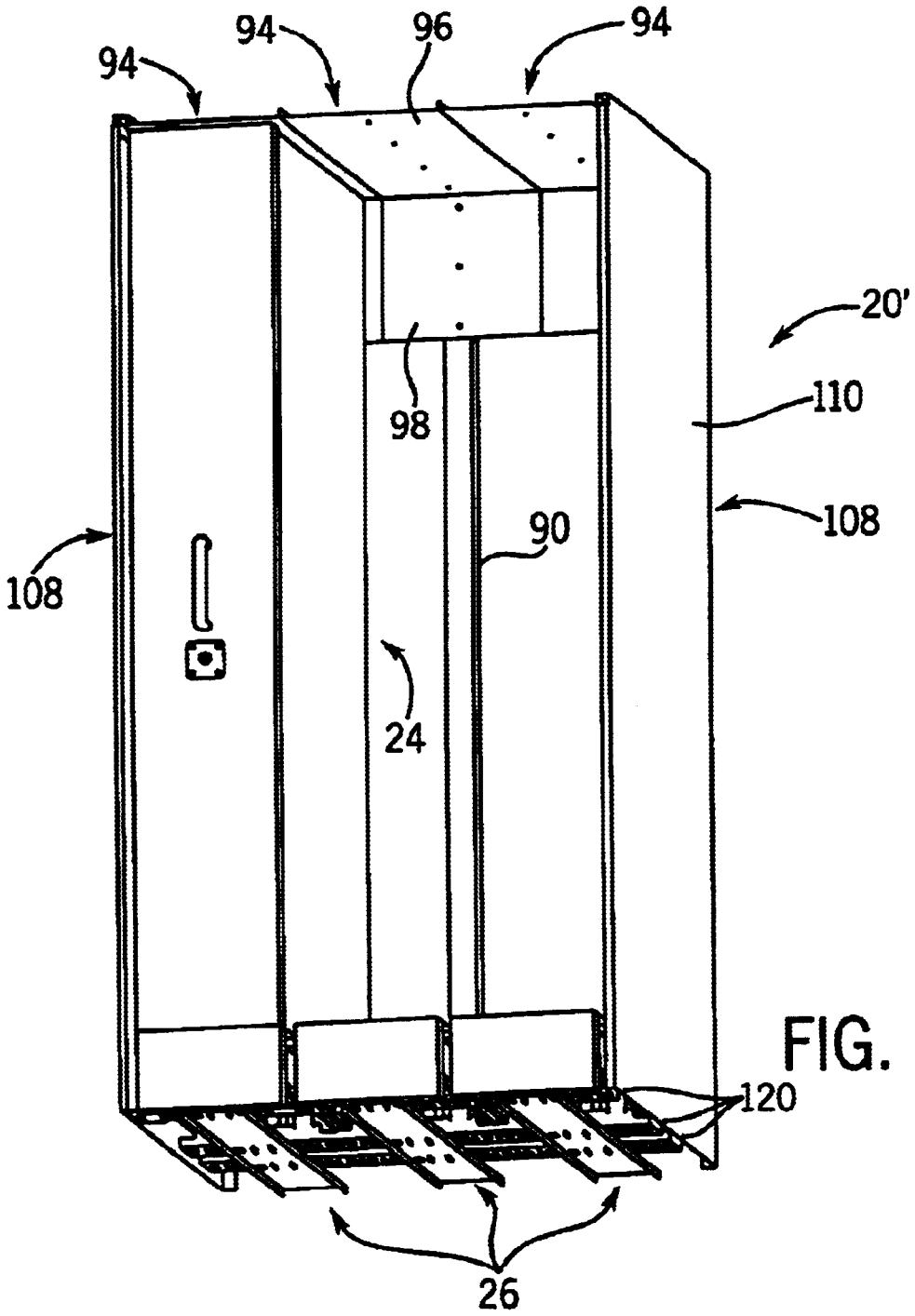
FIG. 7 is a bottom isometric view of the storage unit enclosure and stabilizing system of FIG. 6.

FIGS. 2–5 illustrate an alternative version, in which individual stabilizing members 50 are engaged with a bracket 52 which in turn is mounted to wall 53 which extends upwardly from floor 28. As shown in FIG. 3, bracket 52 includes a rear wall 54 adapted for placement against wall 53, and a bottom flange 56 extending outwardly from the lower end of rear wall 54. Bracket 52 further includes a top flange 58 extending outwardly from the top of rear wall 54, and a lip 60 which extends downwardly from the outer end of top flange 58. Bracket 52 is mounted to wall 53 by means of a pair of anchor bolts 62 which extend through openings 64 formed in rear wall 54 and into engagement with anchors embedded in wall 53.

Each stabilizing member 50 includes an outer section 66 and an inner section 68. An upstanding mounting section 70 extends upwardly from the end of inner section 68. The upper end of mounting section 70 is received within the space between lip 60 and rear wall 54 of bracket 52, and the end of inner section 68 rests on lower flange 56. With this construction, each mounting member 50 is slidable on bracket 52 to a desired position such that stabilizing member 50 is located over one of storage units 22. In a preferred form, the head of each screw 62 is received within a recess associated with its respective opening 64, such that heads 62 do not interfere with sliding movement of stabilizing members 50 relative to bracket 52.

A slide-type engagement mechanism 48 is interposed between each stabilizing member 50 and one of storage units 22. A slide-type engagement mechanism 48 is engaged with each stabilizing member 46 in the version of FIG. 1, and with each stabilizing member 50 in the version of FIGS. 2–5. Each engagement mechanism 48 includes an inverted U-shaped top mounting member 72 which is secured to a stabilizing member, such as 46 or 50, in a conventional manner such as by engagement of screws 74 within threaded openings formed in mounting member 72. Each engagement mechanism 48 further includes an inner extension member 76 fixed to top wall 30 of cabinet assembly 24 using fasteners such as screws 78, and a slide member 80 interposed between mounting member 72 and extension member 76. In a manner as is known, slide member 80 is slidably mounted to mounting member 72 for extension and retraction, and extension member 76 is slidably mounted to slide member 80 for extension and retraction. Low friction members, such as ball bearings, are interposed between mounting member 72 and slide member 80, and between slide member 80 and extension member 76.

In operation, slide-type engagement mechanism 48 functions to maintain engagement of storage unit 22 with a stabilizing member, such as 46 or 50, during extension and retraction of storage unit 22. The size of engagement mechanism 48 is selected, and stabilizing members 46 and 50 are appropriately designed, such that any transverse force applied to storage unit 22 is transferred through engagement mechanism 48 to the stabilizing member, such as 46 or 50. In the case of stabilizing members 46, any such transverse force is resisted by the structure of stabilizing system 36, i.e. top cross-member 44 and posts 38 and connection of posts 38 to floor 28, as well as by engagement of other stabilizing members 46 with the respective storage units 22. In the case of stabilizing members 50, any such transverse force is resisted by bracket 52 and connection thereof to wall 54.

FIGS. 1–5 illustrate engagement mechanism 48 connected to top wall 30 of cabinet assembly 24. It should be understood that engagement mechanism 48 could be engaged with cabinet assembly 24 at any other satisfactory location above base 26. Most preferably, engagement mechanism 48 is located above the center of gravity of cabinet assembly 24 and, in a particularly preferred form, each engagement mechanism 48 is connected to top wall 30, as shown.

FIGS. 6–10 illustrate an alternative storage system 20' constructed according to the invention. Where possible, like reference characters will be used to facilitate clarity.

Figure 8:
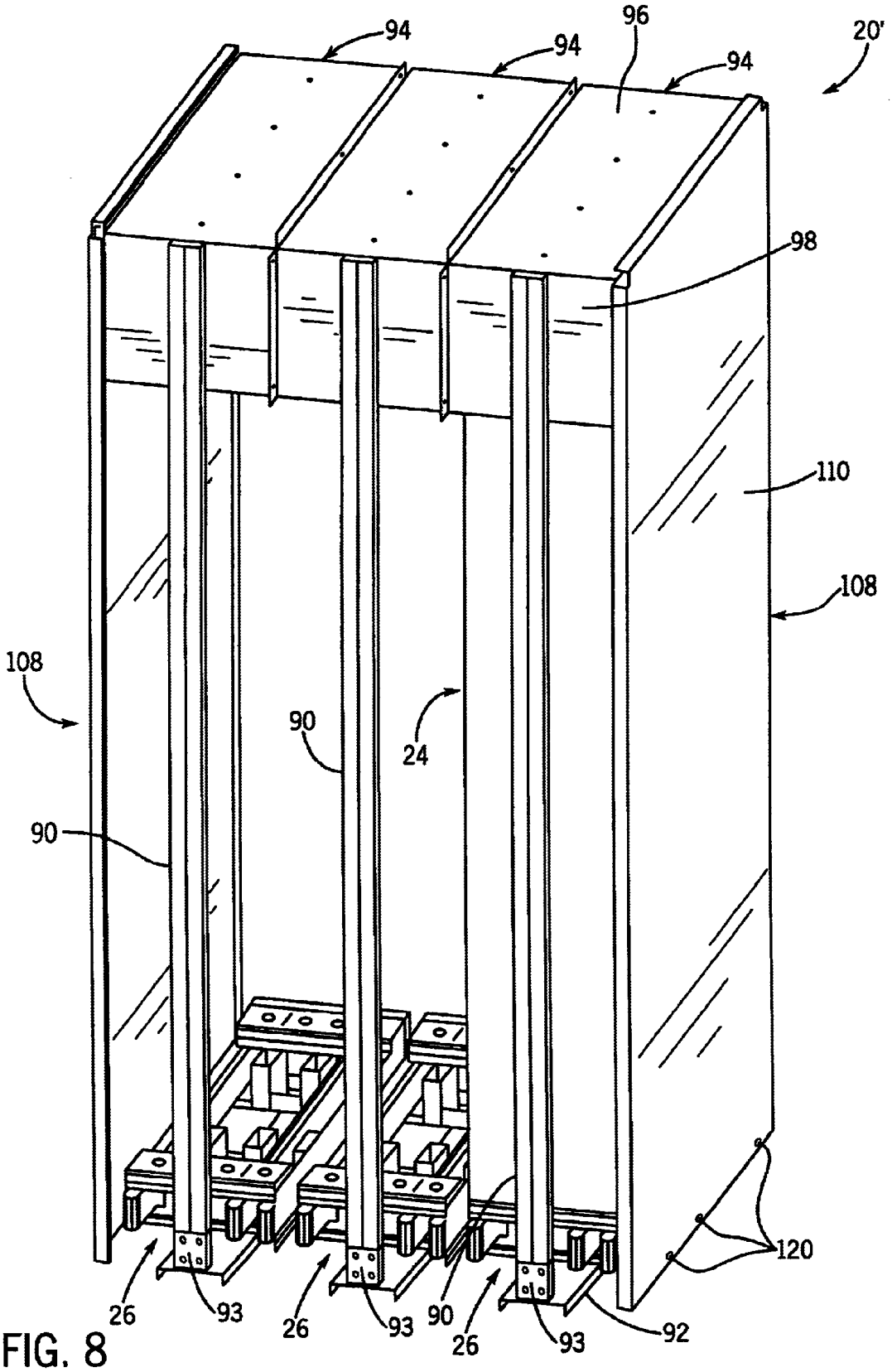
FIG. 8 is a rear isometric view of the storage unit enclosure and stabilizing system of FIGS. 6 and 7.
Figure 9:
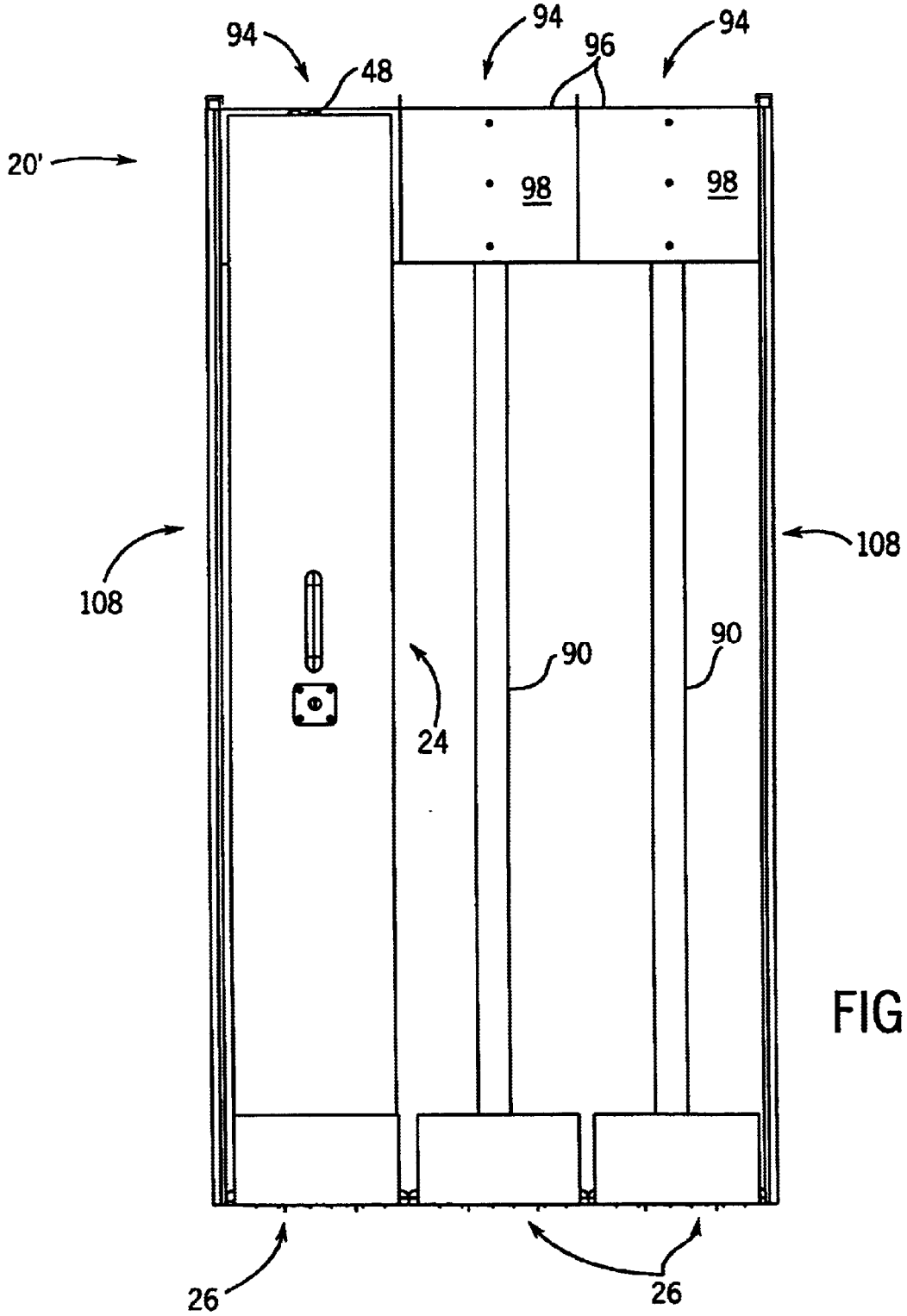
FIG. 9 is a front elevation view of the storage unit enclosure and stabilizing system of FIGS. 6–8.

Storage system 20' includes storage units 22, each of which includes a cabinet assembly 24 mounted for sliding movement to a base assembly 26, which is secured to the floor 28 or other supporting surface. As shown in FIG. 8, a rear post 90 has a lower end which is rigidly mounted to a mounting plate 92 of base assembly 26 via a bracket 93, extending vertically upwardly therefrom. The upper end of each post 90 is secured to a stabilizing member 94, and each stabilizing member 94 defines a top panel 96 and a rear panel 98. Top panel 96 has a length slightly greater than the width of cabinet assembly 24. Top panel 96 and rear panel 98 are formed of a bent sheet of material, such that top panel 96 and rear panel 98 are formed integrally with each other. Rear panel 98 of each stabilizing member 94 is engaged with the upper end of one of posts 90, utilizing screws, spot welding or any other satisfactory engagement arrangement.

Figure 10:
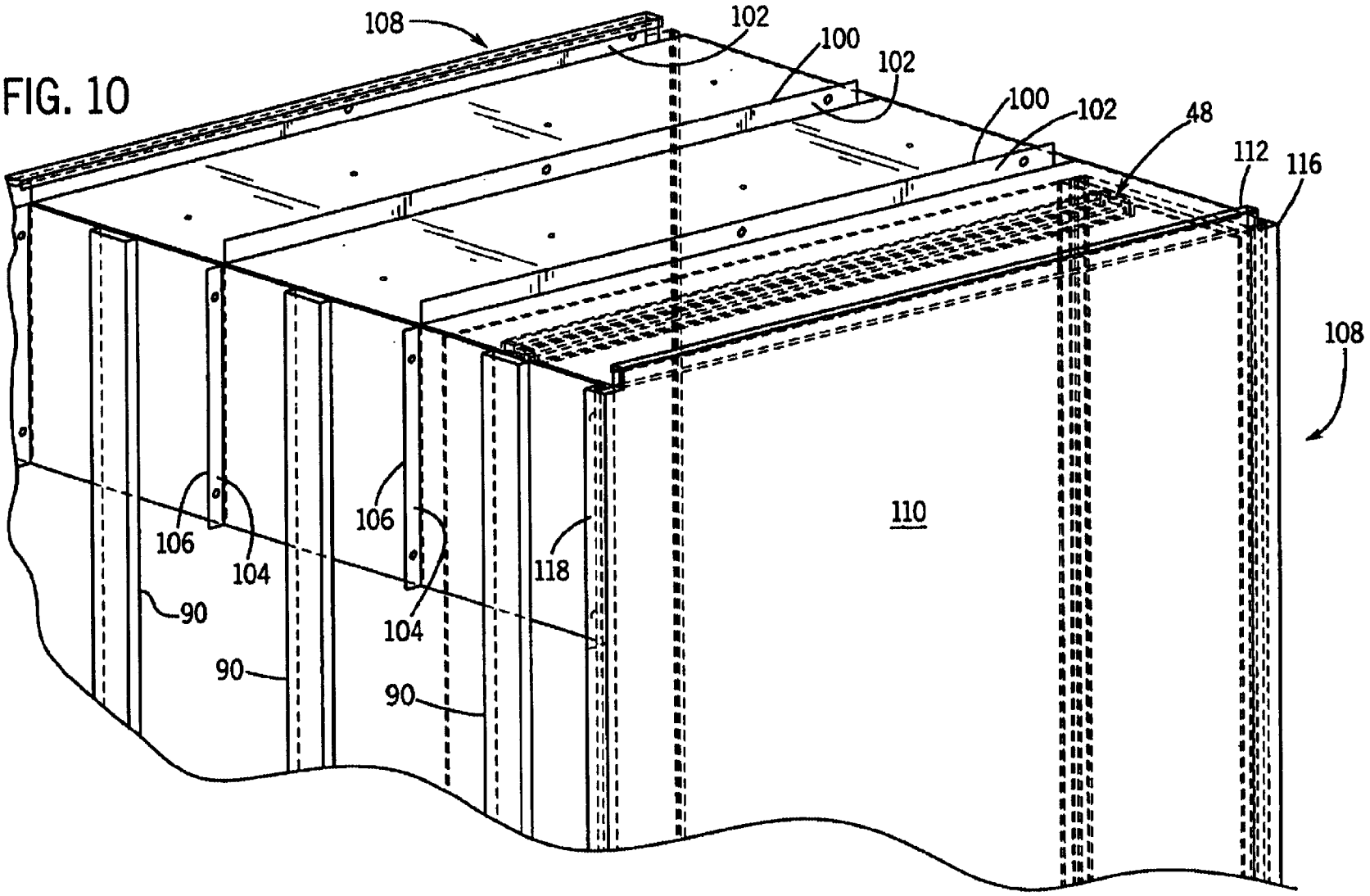
FIG. 10 is a partial perspective view showing the upper portion of the storage unit enclosure stabilizing system of FIGS. 6–9.
Figure 11:
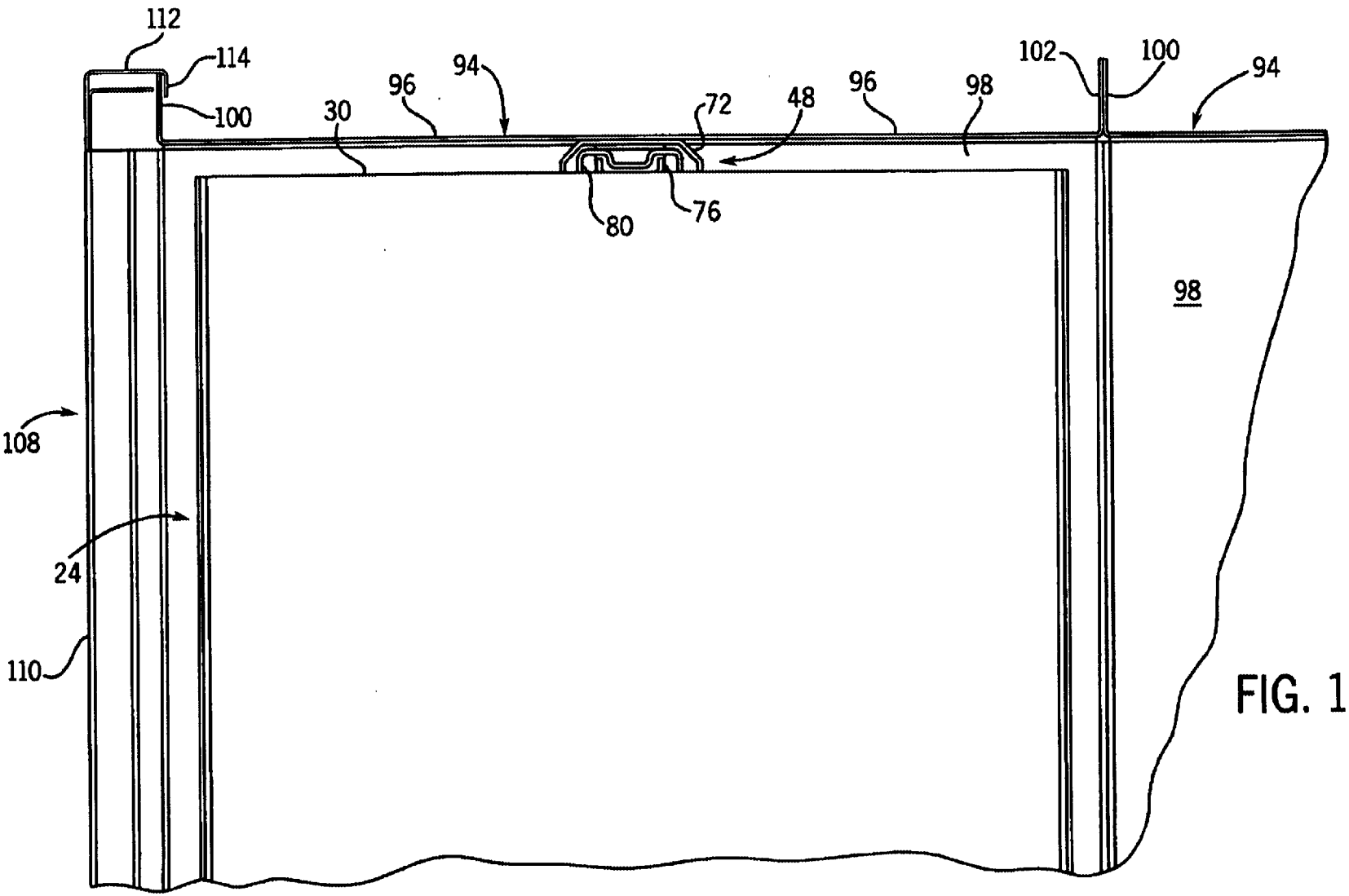
FIG. 11 is a partial front elevation view showing the upper portion of the storage unit enclosure and stabilizing system of FIGS. 6–10.

Referring to FIGS. 10 and 11, a flange 100 is formed along one side of each top panel 96, and a flange 102 is formed along the opposite side of each top panel 96. In a similar manner, a flange 104 is formed along one side of each rear panel 98, and a flange 106 is formed at the opposite side of each rear panel 98. Openings are formed in flanges 100, 102 and in flanges 104, 106, and the openings are in alignment with each other. With this arrangement, adjacent stabilizing members 94 are secured together by use of conventional connectors extending through the aligned openings in flanges 100, 102 and in flanges 104, 106.

As best shown in FIG. 11, slide-type engagement mechanism 48 is located between and engaged with the underside of top panel 96 and the upper surface of top wall 30 of cabinet assembly 24.

Referring to FIGS. 6–8 and 11, an end enclosure panel 108 is located at each end of storage system 20'. Each enclosure panel 108 includes a side wall 110, and an upper flange 112 with a depending lip 114 is located at the upper edge of side wall 110. A flange 116 is located at the outer vertical edge of side wall 110, and a flange 118 is located at the inner vertical edge of side wall 110. A lip extends from the outer edge of flanges 116, 118. Openings 120 are formed in side wall 110 adjacent its lower edge.

An end enclosure panel 108 is engaged with each endmost storage unit 22 in storage system 20'. While the drawings illustrate three storage units 22, it is understood that any number of storage units 22 may be placed side-by-side and stabilized and enclosed utilizing posts 90, stabilizing members 94 and end enclosure panels 108. To mount end enclosure panel 108, top flange 112 of end enclosure panel 108 is positioned such that its depending lip 114 overlies the end flange, such as 100, of stabilizing member 94, as shown in FIG. 11. To do this, the user manually positions end enclosure panel 108 such that lip 114 is located vertically above the upper end of flange 100. The user then moves enclosure panel 108 downwardly into the position as shown in FIG. 11, in which lip 114 overlies the upper end of flange 100 and flange 100 engages top flange 112. The user then engages the lip of rear flange 118 with the endmost one of flanges 104, 106 on the endmost rear panel 98. Threaded fasteners, such as screws, are then inserted through openings 120 in the lower end of wall 110, into engagement with conventional L-shaped mounting brackets secured to the endmost base assembly 26. This functions to lock end enclosure panel 108 to the endmost base assembly 26 and to the endmost stabilizing member 94, and stabilizing members 94 in turn are each engaged with a base assembly 26 through a rear post 90. The interconnected end enclosure panels 108, stabilizing members 94, rear posts 90 and base assemblies 26 thus function to provide a rigid structure or housing about cabinet assemblies 24, which in turn is secured to the floor by the rigid mounting of each base assembly 26 to the floor. Cabinet assemblies 24 are slidably mounted to the rigid structure by the slide-type extension and retraction assembly which mount each cabinet assembly 24 to its respective base assembly 26, and by the slide-type engagement mechanism 48 which engages each cabinet assembly 24 with one of stabilizing members 94. In this arrangement, the cabinet assemblies are enclosed by stabilizing members 94 and end enclosure panels 108. Further, each cabinet assembly 24 is stabilized against tipping by engagement of its respective slide-type engagement mechanism 48 with the rigid, floor-mounted structure which surrounds cabinet assemblies 24.

It can thus be appreciated that the present invention provides a relatively simple and easily installed stabilizing system for pull-out storage units. The invention takes advantage of conventional technology in the field of extendible slide mechanisms, and employs such a mechanism in a unique application for stabilizing a movable storage unit. The stabilizing system is suitable for new and existing installations, and provides a unique and easily constructed arrangement for enclosing such a system.

Various alternatives and embodiments are contemplated as being within the scope of the following claims particularly pointing out and distinctly claiming the subject matter regarded as the invention.

I claim:

1. A storage system, comprising:

a series of side by-side storage units, each of which includes a separate base adapted for rigid mounting to a stationary structure, and a separate storage member movably mounted to the base for movement between a retracted position and an extended position, wherein adjacent storage units are open to each other;

a separate top wall structure for each storage unit, wherein the separate top wall structure overlies an upper end defined by its associated storage member, wherein the top wall structures of adjacent storage units are connected together; and a pair of end panels, wherein a first end panel is engaged with the top wall structure and with the base associated with a first endmost one of the storage units, and wherein a second one of the end panels is engaged with the top wall structure and with the base associated with a second endmost one of the storage units, wherein the end panels and the top wall structures cooperate to form an enclosure of the storage units and the bases.

2. The storage system of claim 1, further comprising a reinforcing member extending between and interconnecting the base of each storage unit with the top wall structure located above the storage member.

3. The storage system of claim 2, wherein each top wall structure is interconnected with a rear panel, and wherein the reinforcing member comprises a post member extending between each rear panel and the base of one of the storage units.

4. The storage system of claim 1, further comprising an extendible and retractable engagement mechanism interposed between each top wall structure and a top wall defined by the storage member.

5. The storage system of claim 4, wherein the extendible and retractable engagement mechanism comprises a slide-type engagement mechanism having a stationary member engaged with the top wall structure and one or more extension members mounted for slidable extension and retraction relative to the stationary member and interconnected with the top wall of the storage member.

6. A storage system adapted for placement in a room having a floor and one or more walls, comprising:

plurality of separate storage units, wherein each storage unit defines a lower end;

a plurality of separate bases, wherein each base is fixed to the floor and is configured to support one of the storage units at a location toward the lower end of the storage unit, and wherein each base includes an axially movable support arrangement engaged with one of the storage units that is operable to enable movement of the storage unit relative to the floor between an extended position and a retracted position; and a stabilizing arrangement interconnected between the floor and each storage unit and engaged with the storage unit at a location above a center of gravity defined by the storage unit, wherein the stabilizing arrangement comprises a plurality of seperate stabilizing members, wherein the stabilizing members are located above the bases and above an upper end defined by each of the storage units, wherein the plurality of separate stabilizing members are connected together and are interconnected with the bases to stationarily secure the connected stabilizing members to the floor, and an extendible and retractable engagement arrangement interconnected between the connected stabilizing members and each storage unit, for imparting stability to the storage unit during movement of the storage unit between its extended and retracted positions, wherein the extendible and retractable engagement arrangement has a first length when the storage unit is in its extended position and a second length that is shorter than the first length when the storage unit is in its retracted position.

7. The storage system of claim 6, wherein each stabilizing member is located above and interconnected with one of the bases.

8. The storage system of claim 7, wherein each stabilizing member is located adjacent a top wall defined by one of the storage units, and wherein the extendible and retractable engagement arrangement includes a stationary member engaged with the stabilizing member and an extendible member slidably engaged with the stationary member and secured to the top wall of the storage unit.

9. The storage system of claim 8, wherein each stabilizing member is interconnected with one of the bases by means of a post extending upwardly from the base and interconnected with the stabilizing member toward an upper end defined by the post.

10. A storage system, comprising:

a plurality of separate storage units, wherein each storage unit defines a lower end;

a plurality of separate bases, wherein each base is rigidly mounted to a floor and is configured to support one of the storage units at a location toward the lower end of the storage unit, and wherein each base includes an axially movable support arrangement engaged with one of the storage units that is operable to enable movement of the storage unit relative to the floor between an extended position and a retracted position; and a stabilizing arrangement interconnected between the floor and the storage unit at a location above a center of gravity defined by the storage unit, comprising a stabilizing member stationarily interconnected with the base and located adjacent a top wall defined by the storage unit, wherein the stabilizing member is interconnected with the base of the storage unit by means of a post extending upwardly from the base and interconnected with the stabilizing member toward an upper end defined by the post, and an extendible and retractable engagement arrangement interconnected between the stabilizing member and each storage unit, wherein the extendible and retractable engagement arrangement includes a stationary member engaged with the stabilizing member and an extendible member slidably engaged with the stationary member and secured to the top wall of the storage unit, for imparting stability to the storage unit during movement of the storage unit between its extended and retracted positions, wherein the extendible and retractable engagement arrangement has a first length when the storage unit is in its extended position and a second length that is shorter than the first length when the storage unit is in its retracted position;

wherein a series of storage units are adapted for placement in a side-by-side manner, and wherein a separate stabilizing member is located above each storage unit, wherein adjacent stabilizing members are adapted to be interconnected together.

11. The storage system of claim 10, further comprising an end panel engageable with the stabilizing member of the endmost storage unit and with the base of the endmost storage unit.

12. A storage system, comprising:

one or more storage units, wherein each storage unit includes a lower end and a base, wherein the base includes an axially movable support engaged with the lower end of the storage unit, wherein the axially movable support is constructed and arranged to provide support to the storage unit from below a center of gravity defined by the storage unit and to provide movement of the storage unit between an extended position and a retracted position;

a stationary stabilizing arrangement located above the base, wherein the stationary stabilizing arrangement comprises the base of the storage unit in combination with a post interconnected with and extending upwardly from the base, a stabilizing member interconnected with the post, and a pair of end enclosure members located one on either side or the storage unit, wherein each end enclosure member is engaged at an upper end with an endmost one of the stabilizing members and at a lower end with the base wherein a series of storage units are mounted in a side-by-side manner, and wherein a post extends upwardly from the base of each storage unit and is interconnected with a stabilizing member located above each storage unit, wherein the stabilizing members are interconnected with each other and wherein a first end enclosure member is mounted to a first endmost one of the stabilizing members and a second end enclosure member is mounted to a second endmost one of the stabilizing members; and a telescoping slide mechanism interposed between the storage unit and the stationary stabilizing arrangement, wherein the telescoping slide mechanism is separate from the support and is interconnected with the storage unit above the center of gravity of the storage unit, wherein the telescoping slide mechanism includes a fixed first member interconnected with the stationary stabilizing arrangement, and an axially movable second member interconnected with the storage unit and axially movable relative to the fixed first member between an extended position and a retracted position along with the storage unit upon movement of the storage unit between its extended and retracted positions, wherein the telescoping slide mechanism has a first length when the storage unit is in its extended position and a second length that is shorter than the first length when the storage unit is in its retracted position, and wherein the slide mechanism is operable to maintain engagement of the storage unit with the stabilizing arrangement at a location above the base and the center of gravity of the storage unit to stabilize the storage unit against tipping.

* * * * *

UNITED STATES PATENT AND TRADEMARK OFFICE

CERTIFICATE OF CORRECTION

PATENT NO. : 6,688,708 B1
DATED : February 10, 2004
INVENTOR(S) : Steven L. Janson It is certified that error appears in the above-identified patent and that said Letters Patent is hereby corrected as shown below:

Title page,
Item [56], References Cited, FOREIGN PATENT DOCUMENTS, please add:
-- 0353019 1-1990 Europe
04183408 6-1992 Japan --.

Column 7,
Line 46, before "plurality" insert -- a --;

Column 9,
Line 20, after "base" insert -- , --.

Signed and Sealed this

Twenty-seventh Day of April, 2004

JON W. DUDAS
*Acting Director of the United States Patent and Trademark Office*